US012279747B2

(12) United States Patent
Dimbylow et al.

(10) Patent No.: US 12,279,747 B2
(45) Date of Patent: Apr. 22, 2025

(54) CLEANER HEAD FOR A VACUUM CLEANER

(71) Applicant: Dyson Technology Limited, Wiltshire (GB)

(72) Inventors: Stephen Robert Dimbylow, Swindon (GB); Andrew David Warrington, Bristol (GB); Henry Thomas James Barnard, Bristol (GB)

(73) Assignee: Dyson Technology Limited, Malmesbury (GB)

( * ) Notice: Subject to any disclaimer, the term of this patent is extended or adjusted under 35 U.S.C. 154(b) by 144 days.

(21) Appl. No.: 17/789,602

(22) PCT Filed: Jan. 22, 2021

(86) PCT No.: PCT/GB2021/050140
§ 371 (c)(1),
(2) Date: Jun. 28, 2022

(87) PCT Pub. No.: WO2021/152292
PCT Pub. Date: Aug. 5, 2021

(65) Prior Publication Data

US 2023/0036398 A1 Feb. 2, 2023

(30) Foreign Application Priority Data

Jan. 31, 2020 (GB) ..... 2001359

(51) Int. Cl.
*A47L 9/04* (2006.01)
*A47L 5/26* (2006.01)
(Continued)

(52) U.S. Cl.
CPC ..... *A47L 9/30* (2013.01); *A47L 5/26* (2013.01); *A47L 9/04* (2013.01); *A47L 9/2836* (2013.01); *A47L 5/28* (2013.01)

(58) Field of Classification Search
CPC . A47L 9/30; A47L 9/2836; A47L 9/04; A47L 9/0477; A47L 9/28; A47L 5/26; A47L 5/30
(Continued)

(56) References Cited

U.S. PATENT DOCUMENTS 4,757,574 A 7/1988 Sumerau
6,490,755 B2 * 12/2002 Paterson ..... A47L 7/0009 362/91
(Continued)

FOREIGN PATENT DOCUMENTS

CN 106556607 A 4/2017
CN 107744371 A 3/2018
(Continued)

OTHER PUBLICATIONS

JP-2013220206-A translation espacenet (Year: 2024).*
(Continued)

*Primary Examiner* — Michael D Jennings
(74) *Attorney, Agent, or Firm* — Tucker Ellis LLP; Michael G. Craig

(57) ABSTRACT

A cleaner head for a vacuum cleaner includes a laser diode for illuminating debris located upon a region of a work surface located in front of the cleaner head with green light.

15 Claims, 5 Drawing Sheets

(51) Int. Cl.
*A47L 9/28* (2006.01)
*A47L 9/30* (2006.01)
*A47L 5/28* (2006.01)

(58) Field of Classification Search
USPC ..... 15/324
See application file for complete search history.

(56) References Cited

U.S. PATENT DOCUMENTS

| | | | | |
|---|---|---|---|---|
| 6,672,735 | B2 | 1/2004 | Dilger et al. | |
| 7,627,927 | B2 | 12/2009 | Blocker et al. | |
| 8,631,538 | B2 | 1/2014 | Huffman | |
| 8,707,499 | B2 | 4/2014 | Clark | |
| 8,926,117 | B2 | 1/2015 | Blanchette | |
| 9,657,936 | B2 | 5/2017 | Carr, Jr. et al. | |
| 2017/0137663 | A9 | 5/2017 | Wakamatsu et al. | |
| 2019/0029486 | A1 | 1/2019 | Suvarna et al. | |
| 2021/0307581 | A1* | 10/2021 | Thorne | A47L 9/2884 |
| 2023/0029933 | A1 | 2/2023 | Dimbylow et al. | |

FOREIGN PATENT DOCUMENTS

| | | | | | |
|---|---|---|---|---|---|
| CN | 109303521 | A | | 2/2019 | |
| DE | 102011054706 | A1 | * | 9/2012 | A47L 9/28 |
| EP | 2541272 | A2 | | 1/2013 | |
| EP | 3295854 | A1 | | 3/2018 | |
| JP | 3138321 | U | | 12/2007 | |
| JP | 2010-005094 | A | | 1/2010 | |
| JP | 2010279652 | A | * | 12/2010 | |
| JP | 2013-101003 | A | | 5/2013 | |
| JP | 2013172808 | A | | 9/2013 | |
| JP | 2013220206 | A | * | 10/2013 | |
| JP | 2013-226176 | A | | 11/2013 | |
| JP | 2016-052515 | A | | 4/2016 | |
| JP | 2018192064 | A | * | 12/2018 | |
| KR | 10-1937413 | B1 | | 1/2019 | |
| WO | 2008/035478 | A1 | | 3/2008 | |
| WO | 2009/029280 | A1 | | 3/2009 | |

OTHER PUBLICATIONS

DE-102011054706-A1 translation espacenet (Year: 2024).*
JP-2010279652-A translation espacenet (Year: 2024).*
JP-2018192064-A espacenet (Year: 2024).*
DE-102011054706-A1 espacenet (Year: 2024).*
JP-2010279652-A espacenet (Year: 2024).*
Office Action received for Japanese Patent Application No. 2022-535249, mailed on Jul. 25, 2023, 13 pages (5 pages of English Translation and 8 pages of Original Document).
International Search Report and Written Opinion received for PCT Patent Application No. PCT/GB2021/050140, mailed on Apr. 15, 2021, 9 pages.
International Search Report and Written Opinion received for PCT Patent Application No. PCT/GB2021/050141, mailed on Apr. 15, 2021, 9 pages.
Office Action received for Patent Application No. GB 2001362.9, mailed on Jun. 29, 2020, 2 pages.
Office Action received for Patent Application No. GB 2001359.5, mailed on Sep. 15, 2020, 2 pages.
Office Action received for Chinese Patent Application No. 202180007541.5, mailed on Mar. 4, 2023, 16 pages (9 pages of English Translation and 7 pages of Original Document).
Office Action received for Chinese Patent Application No. 202180007540.0, mailed on Feb. 10, 2023, 16 pages (10 pages of English Translation and 6 pages of Original Document).

* cited by examiner

CLEANER HEAD FOR A VACUUM CLEANER

CROSS-REFERENCE TO PRIOR APPLICATION

This application is a § 371 National Stage Application of PCT International Application No. PCT/GB2021/050140 filed Jan. 22, 2021, which claims the priority of United Kingdom Application No. 2001359.5, filed Jan. 31, 2020, each of which are herein incorporated by reference in their entirety.

FIELD OF THE INVENTION

The present invention relates to a cleaner head for a vacuum cleaner, and to a vacuum cleaner includes such a cleaner head.

BACKGROUND OF THE INVENTION

A vacuum cleaner typically comprises a main body containing dirt and dust separating apparatus, a cleaner head connected to the main body and having an opening, and a motor-driven fan unit for drawing dirt-bearing air through the opening and the cleaner head, and into the main body. The opening is directed downwardly to face the floor surface to be cleaned. The dirt-bearing air is conveyed to the separating apparatus so that dirt and dust can be separated from the air before the air is expelled to the atmosphere. The separating apparatus can include one or more of a filter, a filter bag and a cyclonic arrangement.

A driven agitator, usually in the form of a brush bar, may be rotatably mounted within a suction cavity of the cleaner head. The brush bar typically comprises an elongate cylindrical core bearing bristles which extend radially outward from the core. The opening is in the form of an aperture, usually an elongate, rectangular aperture, defined by a sole plate located on the base of the cleaner head. The brush bar may be mounted within the suction cavity so that the bristles protrude by a small extent through the opening.

The brush bar is activated mainly when the vacuum cleaner is used to clean carpeted surfaces. Rotation of the brush bar may be driven by an electric motor powered by a power supply derived from the main body of the vacuum cleaner, or by a turbine driven by an air flow passing through or into the cleaner head. The brush bar may be driven by the motor via a drive belt, or may be driven directly by the motor, so as to rotate within the suction cavity. Rotation of the brush bar causes the bristles to sweep along the surface of the carpet, agitating both the fibres of the carpet and any dust or other detritus located on the surface of the carpet and/or between fibres of the carpet, and resulting in a significant amount of energy being imparted to the dust. With the brush bar rotating in such a direction that the bristles move from the front edge of the opening towards the rear edge, the rotating bristles sweep dust rearwardly through the opening and into the suction cavity. The suction of air causes air to flow underneath the sole plate and around the brush bar to help lift the dirt and dust from the surface of the carpet and then carry it from the opening through the cleaner head towards the separating apparatus.

To facilitate cleaning of the floor surface, it is known to provide lights on the cleaner head to illuminate a region of the floor surface. This can improve the visualisation of debris, hairs and other objects on the floor surface. For example, U.S. Pat. No. 6,672,735 describes a vacuum cleaner having a lighting system containing a plurality of ultra-bright light emitting diodes (LEDs) for illuminating the floor surface.

SUMMARY OF THE INVENTION

In a first aspect, the present invention provides a cleaner head for a vacuum cleaner, the cleaner head comprising an optical system for illuminating debris upon a region of a work surface located in front of the cleaner head, the optical system comprising a laser diode which emits green light.

The use of a laser diode to illuminate debris disposed on a region of the work surface can reduce power consumption, as the power to light conversion efficiency of a laser diode is generally significantly higher than that of a light emitting diode (LED) and so, for a given optical power output, less electrical power needs to be supplied to a laser diode. As less electrical power needs to be provided to a laser diode, during use laser diodes tend to generate less heat than LEDs, and so there is no requirement to provide any heat dissipation device, such as a fan or a heat sink, to transfer heat from the laser diode to the ambient atmosphere.

The term "green light" means light having a wavelength in the range from 495 to 570 nm. Compared to other colours of light of the same luminosity, green light appears brighter to the human eye, as the human eye contains a greater number of green photo-receptor cone cells than red or blue photo-receptor cells. For example, for a given luminosity, a green laser light will appear around eight times brighter than a red laser light. Thus, for a desired perceived intensity of the illumination of the region of the work surface located in front of the cleaner head, the use of a laser light which emits green light can further allow power consumption to be reduced in comparison with an LED emitting white light.

The term "debris" includes dust, hair, detritus, litter and other undesired materials which may be located upon a work surface, such as a floor surface or a raised surface such as a countertop, table, bench or shelf.

The cleaner head preferably comprises a front edge, a rear edge, and two external, generally parallel side walls extending between the front edge and the rear edge. The front edge of the cleaner head is generally perpendicular to the side walls. The front edge may be defined by the front edge of a floor-engaging sole plate or other structural component containing or defining a suction inlet through which an airflow is drawn into the cleaner head during use of the vacuum cleaner. Alternatively, the front edge of the cleaner head may be defined by an agitator, such as a cylindrical or conical brush bar, or by a body or casing of the cleaner head.

The optical system is preferably located adjacent one of the side walls of the cleaner head, preferably within a housing located between the side wall and a suction chamber or an agitator of the cleaner head. Positioning the optical system to one side of the cleaner head can allow the optical system to be housed within the cleaner head without unduly increasing the height of the cleaner head, and also allow the optical system to be located relatively close to the work surface. The optical system is preferably positioned so that the central axis of a light beam emitted by the optical system contacts a planar work surface on which the cleaner head is located at an acute angle in the range from 0 to 10°, more preferably in the range from 0 to 5°. The optical system is preferably positioned so that a light beam is emitted from the cleaner head at a height of less than 10 mm, more preferably less than 5 mm, from a work surface on which cleaner head is located. Such shallow angle illumination can improve the user's visual detection of debris upon the work surface; light scattered by such debris will appear brighter than light reflected from the work surface, and relatively long shadows will be cast behind the debris, providing a marked contrast with the relatively brightly illuminated debris. Enhancing the illumination of the debris in this manner can greatly assist in user identification of debris located upon the work surface, and improve the likelihood of the debris being captured by the cleaner head in a first forward and backward pass of the cleaner head over the work surface, reducing the time taken to clean the work surface and so reducing power consumption.

Preferably, the majority (that is, at least 50%) of the region of the work surface upon which debris is illuminated by the optical system is bounded by two planes each containing a respective side wall of the cleaner head, so as to provide debris illumination along the path of forward movement of the cleaner head over the work surface. It is preferred, but not essential, that one or more portions of this region of the work surface lie outside of this bounded region, and so provide the user with visibility of any debris lying immediately outside of the path of forward movement of the cleaner head. This can assist the user when deciding how to reposition the cleaner head at the end of the forward movement. As measured in a direction perpendicular to these two planes, the extent to which the debris illumination extends beyond either of these two planes is preferably less than the maximum width of the cleaner head, more preferably less than one half of the maximum width of the cleaner head.

The optical system preferably comprises beam shaping means for receiving light emitted from the laser diode and directing the light towards the work surface such that, when the cleaner head is disposed on a planar work surface, the optical system illuminates debris upon a region of the work surface which is in the shape of a sector. The beam shaping means preferably comprises a lens. The sector may be a circular sector, which is bound by two radii and an arc joining the ends of the radii which are remote from the optical system. Alternatively, the line joining these ends of the radii may have a non-circular curvature or shape, and may be a straight line so that the optical system illuminates debris upon a region of the work surface which is in the shape of a triangle.

The sector preferably has a central angle in the range from 70 to 110°. The central axis, located angularly midway between the two radii bounding the sector, is preferably aligned at an angle in the range from 35 to 65°, more preferably at an angle in the range from 40 to 50°, to the front edge of the cleaner head. One of the radii bounding the sector is preferably aligned at an acute angle of less than 20°, more preferably less than 10°, to the front edge of the cleaner head to maximise debris illumination on a region of the work surface located immediately in front of the cleaner head. The other one of the radii bounding the sector preferably extends outwardly beyond the plane containing the side wall which is proximate to the optical system, and so is preferably aligned at an obtuse angle to the front edge of the cleaner head so as to illuminate debris upon a region of the work surface lying outside of the path of forward movement of the cleaner head. Each of these radii is preferably longer than the maximum width of the cleaner head so as to illuminate debris upon regions of the work surface lying on either side of the path of forward movement of the cleaner head.

In a second aspect the present invention provides a cleaner head for a vacuum cleaner, the cleaner head comprising an optical system located towards one side of the cleaner head, the optical system comprising a light source and beam shaping means for receiving light emitted from the light source and directing the light towards a work surface on which the cleaner head is disposed so as to illuminate debris upon a region of a planar work surface, said region being in the shape of a sector having a central axis aligned at an angle in the range from 35 to 65° to a front edge of the cleaner head, and one of the radii bounding the sector aligned at an acute angle of less than 20° to the front edge of the cleaner head. The light source is preferably a laser diode.

In a third aspect, the present invention provides a vacuum cleaner comprising a cleaner head as aforementioned. The vacuum cleaner is preferably in the form of a handheld or stick vacuum cleaner. The vacuum cleaner is preferably a battery-powered vacuum cleaner.

The optical system is preferably actuated by a controller of the vacuum cleaner. The controller is preferably arranged to actuate the optical system when a suction source of the vacuum cleaner, typically a motor-driven fan unit, is switched on to draw an airflow into the vacuum cleaner through the cleaner head. The controller may supply a constant power to the optical system so that the intensity of the light emitted from the optical system does not vary whilst the suction source is switched on. Alternatively, the controller may vary with time the power supplied to the optical system so that the output optical power of the optical system varies with time.

The power supplied to the optical system may be varied stepwise, or it may be varied gradually. In a preferred embodiment, the power supplied to the optical system is increased gradually from when the suction source is switched on until a maximum supply power is reached. In a preferred embodiment, the maximum optical output power of the laser diode, which in that embodiment is 10 mW, is reached within 1 sec, more preferably within 0.5 sec, of the suction source being switched on. The rate of increase of the power supplied to the optical system may be constant, or it may vary with time. For example, the rate of power increase may be relatively low when the suction source is switched on, and increase gradually, or stepwise, with time. As a further alternative, the controller may delay supplying power to the optical system for a period of time after the suction source has been switched on. This period of relatively low, or no, power supply to the optical system can accommodate a period of time during which the user is positioning the cleaner head on the work surface following the switching on of the suction source, and so accommodate a period of time in which the optical system is not projecting light towards the work surface to be cleaned.

In a fourth aspect the present invention provides a vacuum cleaner comprising a suction source and a cleaner head through which an airflow is drawn into the vacuum cleaner by the suction source, and a controller for controlling the suction source, the cleaner head comprising an optical system for illuminating a region of a work surface located in front of the cleaner head, and wherein, when the suction source is switched on, the controller is arranged to vary with time the power supplied to the optical system.

When the suction source is switched off, the controller is preferably arranged to immediately stop supplying power to the optical system. The controller may be arranged to adjust the supply of power to the optical system depending on change in a state of either the cleaner head or the vacuum cleaner whilst the suction source is switched on. For example, the controller may suspend, reduce or otherwise adjust the supply of power to the optical system depending on an orientation of either of the cleaner head or the vacuum cleaner. One of the cleaner head or the vacuum cleaner may comprise a sensor which outputs to the controller a signal which varies depending on its orientation, and the controller may be arranged to adjust the supply of power to the optical system depending on the output from the sensor. As another example, the controller may adjust the supply of power to the optical system if the cleaner head is lifted away from the work surface. The cleaner head may comprise a sensor such as jockey wheel which detects whether the cleaner head has been lifted from the work surface, or a sensor which detects the pressure of air within the suction chamber, and the controller may be arranged to adjust the supply of power to the optical system depending on a signal received from that sensor. This can reduce the power consumption of the optical system when there is a change in the behaviour of the vacuum cleaner which can be indicative of a break in a cleaning process, for example, the relocation of the vacuum cleaner to another part of a home, and so conserve the energy of the battery.

Features described above in connection with the first aspect of the invention are equally applicable to each of the second to fourth aspects of the invention, and vice versa.

BRIEF DESCRIPTION OF THE DRAWINGS

Preferred features of the invention will now be described, by way of example only, with reference to the accompanying drawings, in which:

FIG. 5 is a graph illustrating the increase with time of the output optical power of the optical system from when the suction source is switched on.

DETAILED DESCRIPTION OF THE INVENTION

Figure 1:
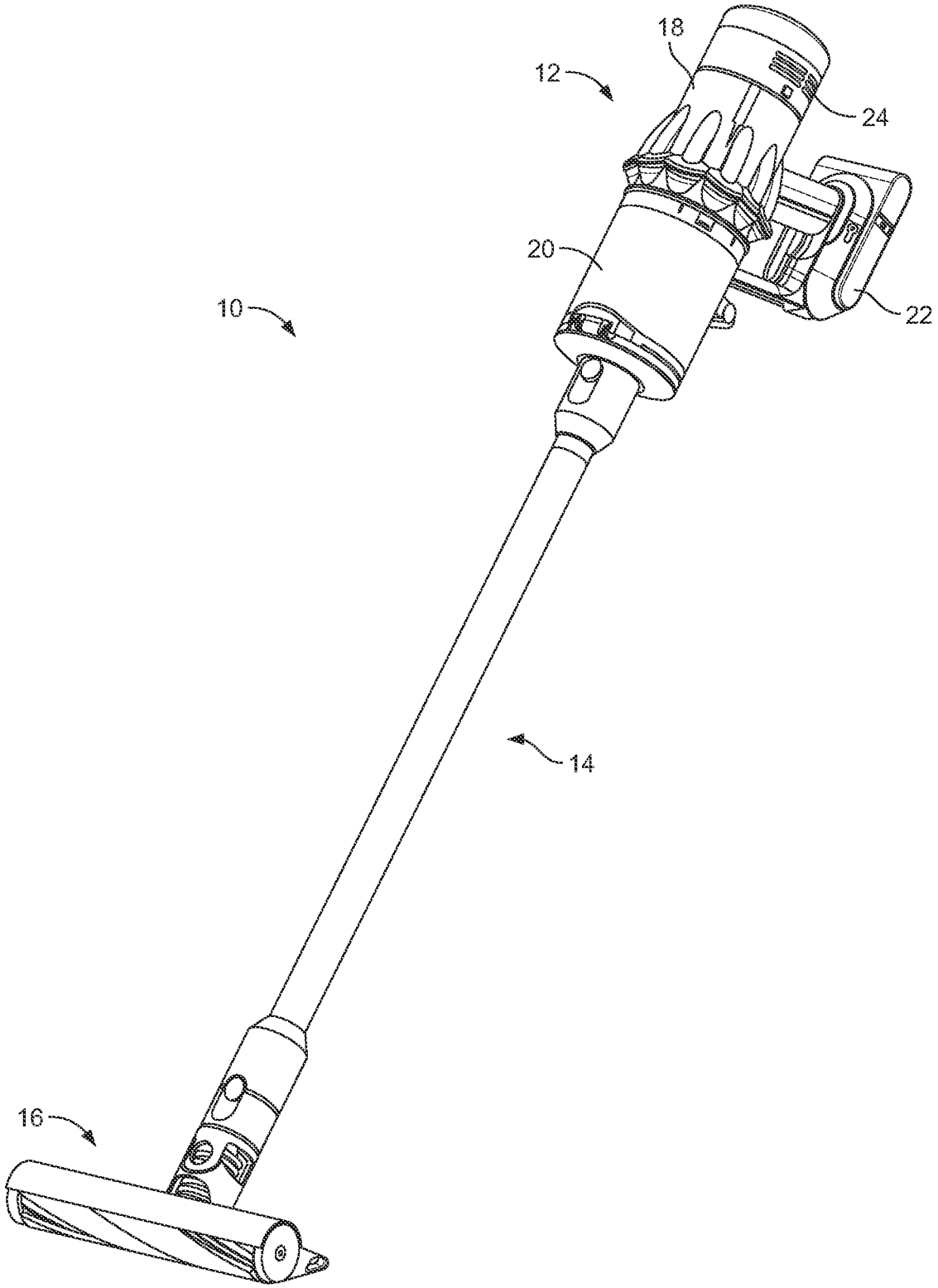
FIG. 1 is a perspective view of a vacuum cleaner.

An embodiment of a vacuum cleaner is illustrated in FIG. 1. The vacuum cleaner 10 comprises a main body 12 which is attached by a wand assembly 14 to a cleaner head 16 through which a dirt-bearing airflow is drawn into the vacuum cleaner 10 by a suction source 18, which is generally a motor-driven fan unit. The vacuum cleaner 10 includes a separation system 20 for separating dirt and other debris from the airflow, a power source 22, in this embodiment a battery, for driving various components of the vacuum cleaner 10, including the suction source 18, and an air outlet 24.

Figure 2:
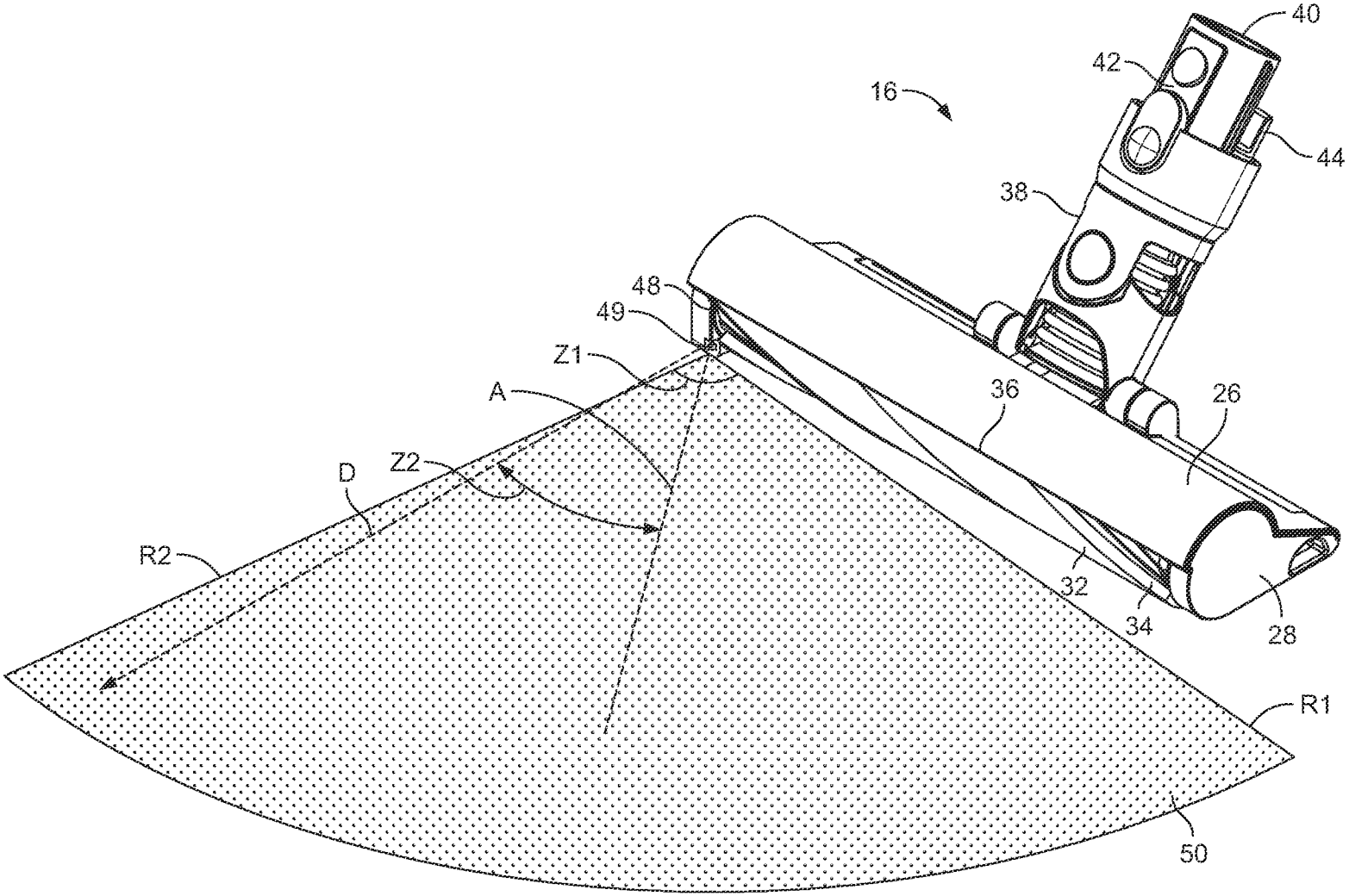
FIG. 2 is a perspective of a cleaner head of the vacuum cleaner, illustrating a region of a work surface upon which debris is illuminated by an optical system of the cleaner head.
Figure 3:
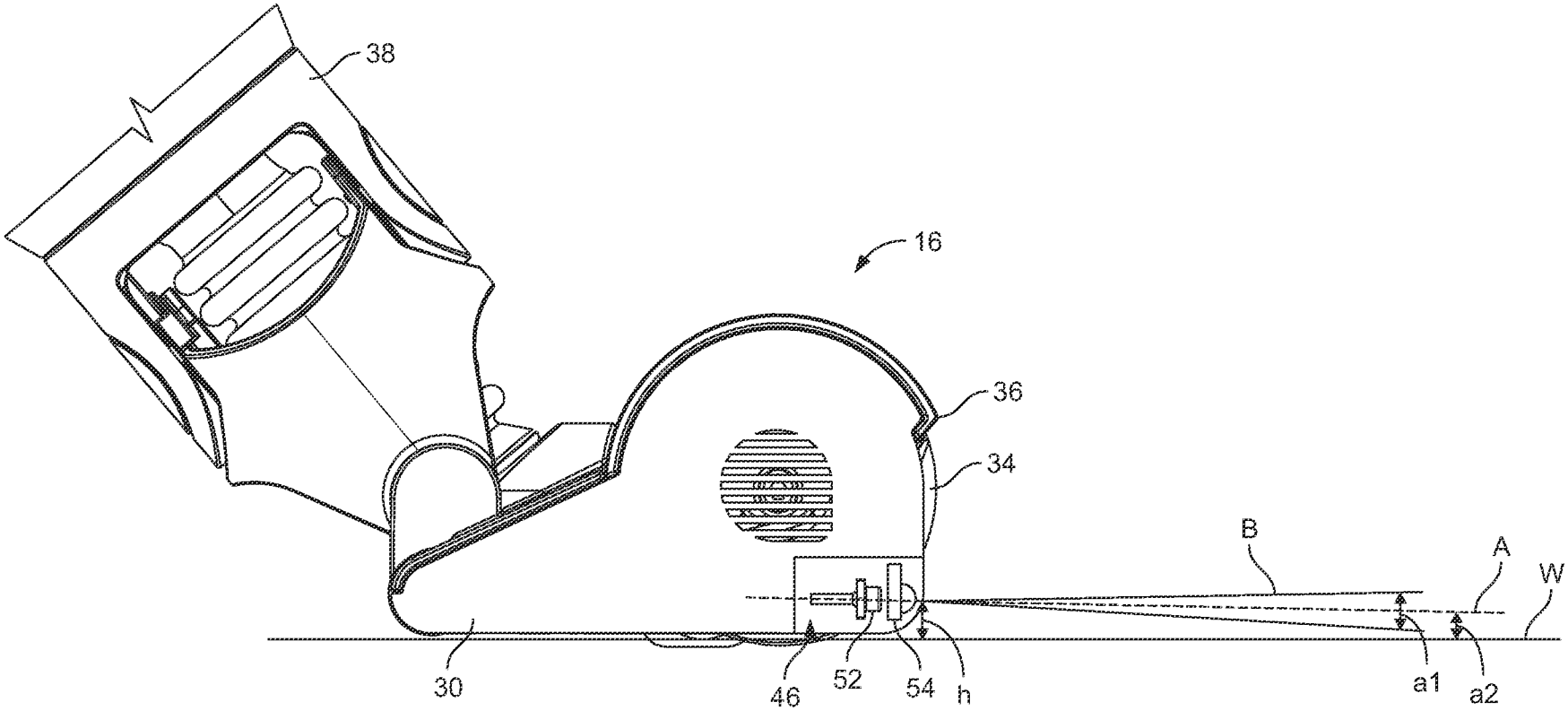
FIG. 3 is a side view of the cleaner head, with part of a side wall cut away to illustrate the components of the optical system.

The cleaner head 16 is illustrated in more detail in FIGS. 2 and 3. The cleaner head 16 comprises a casing 26 which defines opposing, generally parallel side walls 28, 30 of the cleaner head, and a suction chamber into which a dirt-bearing airflow is drawn into the cleaner head. The casing 26 may be formed from a number of different sections joined together. The suction chamber houses an agitator 32 for agitating dirt, dust or other debris from the work surface to become entrained within the airflow. The agitator 32 is in the form of a brush bar which is rotatable relative to the casing 26 about an axis which is collinear with the longitudinal axis of the agitator 32, and which in this embodiment is generally perpendicular to the side walls 28, 30 of the cleaner head 16. In this embodiment, the agitator 32 has a cylindrical shape, and includes rows of bristles 34 for engaging the work surface. A front portion of the agitator 32 is exposed by the casing 26. A front edge 36 of the cleaner head 16 is defined by the casing 26, the front edge 36 extending between, and generally perpendicular to, the side walls 26, 28. Alternatively, the front edge 36 may be defined by the agitator 32. The rotation of the agitator 32 is driven by a motor which is housed either inside the casing 26 or inside the agitator 32. The motor is arranged to rotate the agitator 32 in such a direction that the bristles 34 sweep dirt and debris rearwardly into the suction chamber. The suction chamber conveys the airflow air into a neck 38 of the cleaner head 16, within which the air is conveyed to an outlet 40 of the cleaner head 16.

The neck 38 includes a connector 42 for connecting the cleaner head 16 to the wand assembly 12, and electrical connectors 44 for connecting the motor and an optical system 46 of the cleaner head 16 to the power source 22 of the vacuum cleaner 10.

Figure 4:
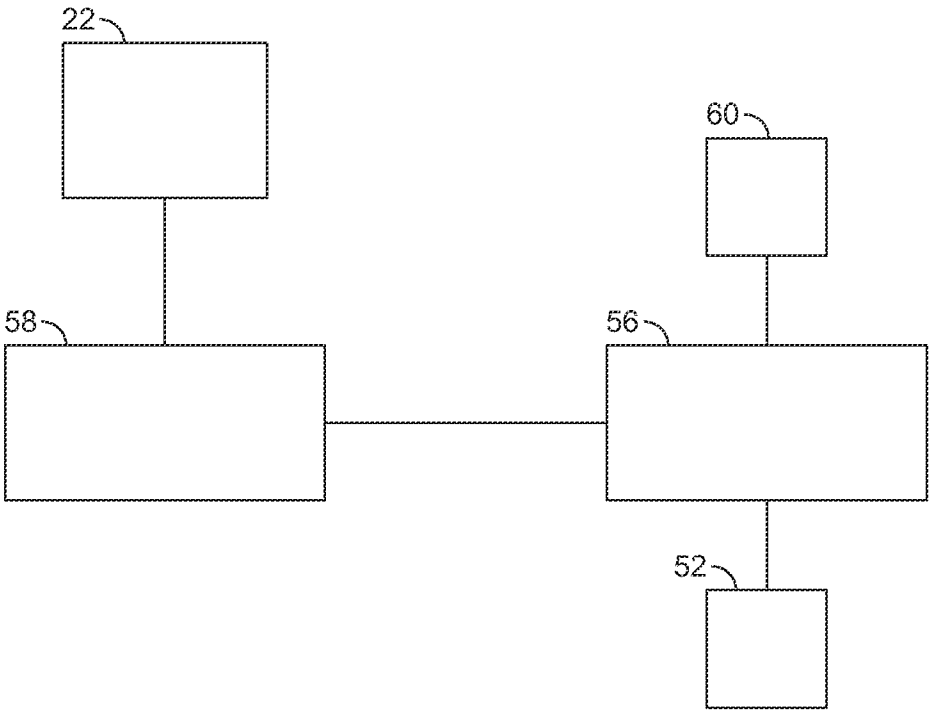
FIG. 4 illustrates schematically a control system for the optical system.

In FIGS. 2 and 3, the cleaner head 16 is illustrated as being located on a planar work surface W, such as a horizontal floor surface. The optical system 46 of the cleaner head 16 is located to one side of the agitator 32, within a housing 48 located between one of the side walls 28, 30 of the cleaner head 16 and the agitator 32. The optical system 46 is arranged to emit light through a window 49 of the housing 48 so as to illuminate debris lying upon a region 50 of the work surface located in front of the cleaner head 16. The optical system 46 comprises a light source 52 for emitting light, and a lens 54 for receiving the emitted light and for directing a light beam towards the work surface. The light source 52 and the lens 54 may be mounted in a module connected to the housing 48. In this embodiment, the light source 52 is a laser diode. A suitable laser diode is an Osram PLT5 510 green laser diode, which has a maximum optical output power of 10 mW at 25° C., and which emits green light at a wavelength of 515 nm. With reference also to FIG. 4, the light source 52 is connected to a controller 56 mounted in the cleaner head 16, preferably within the housing 48. The controller 56 is connected by one or more wires to one or more of the electrical connectors 44 located on the neck 38. When the neck 38 is connected to the wand assembly 14, wires within the wand assembly 14 connect the electrical connectors 44 to a controller 58 located in the main body 12 of the vacuum cleaner 10.

With reference to FIG. 3, the optical system 46 emits a light beam B, in this embodiment a beam of green light, towards the work surface. The beam B is preferably relatively shallow, having a vertical beam spread a1 which is less than 5°. The optical system 46 is positioned within the housing 48 so that the central axis A of the light beam B contacts the work surface W at an acute angle a2 in the range from 0 to 10°, more preferably in the range from 0 to 5°, and in this embodiment at an angle of 2°. The optical system 46 is positioned so that it is close to the work surface, and preferably so that the light beam B is emitted from the cleaner head 16 at a height of less than 10 mm, more preferably less than 5 mm, from the work surface.

Returning to FIG. 2, the optical system 46 is positioned within the housing 48, and the lens 54 is shaped, so as to direct the light beam towards the work surface W such that a region 50 of the work surface upon which debris is illuminated is in the shape of a sector. The sector has two radii R1, R2 which bound the sector, and which define a central angle Z1 of the sector. The central angle Z1 is preferably in the range from 70 to 110°.

The central axis A, located angularly midway between the two radii R1, R2 is preferably aligned at an angle Z2 to the direction D of forward movement of the cleaner head 16 over the work surface W, which direction D is generally parallel to the side walls 26, 28 and perpendicular to the front edge 36 of the cleaner head 16. The angle Z2 is preferably in the range from 25° to 45°, and in this embodiment is 35°. The central axis is thus aligned at an angle which is preferably in the range from 35 to 65°, and in this embodiment is 45°, to the front edge 36 of the cleaner head 16.

Each of the radii R1, R2 is longer than the maximum width of the cleaner head 16 so as to illuminate debris located upon regions of the work surface lying on either side of the path of forward movement of the cleaner head, which in this embodiment is located between the two planes containing the side walls 26, 28 of the cleaner head 16. To illuminate debris upon a region of the work surface W which is immediately in front of the cleaner head 16, the radius R1 is aligned at a relatively small angle, preferably less than 20°, more preferably less than 10°, to the front edge 36 of the cleaner head 16. The other radius R2 is preferably aligned at an obtuse angle to the front edge 36 of the cleaner head 16 so as to illuminate debris upon a region of the work surface lying outside of the path of forward movement of the cleaner head 16.

Figure 5:
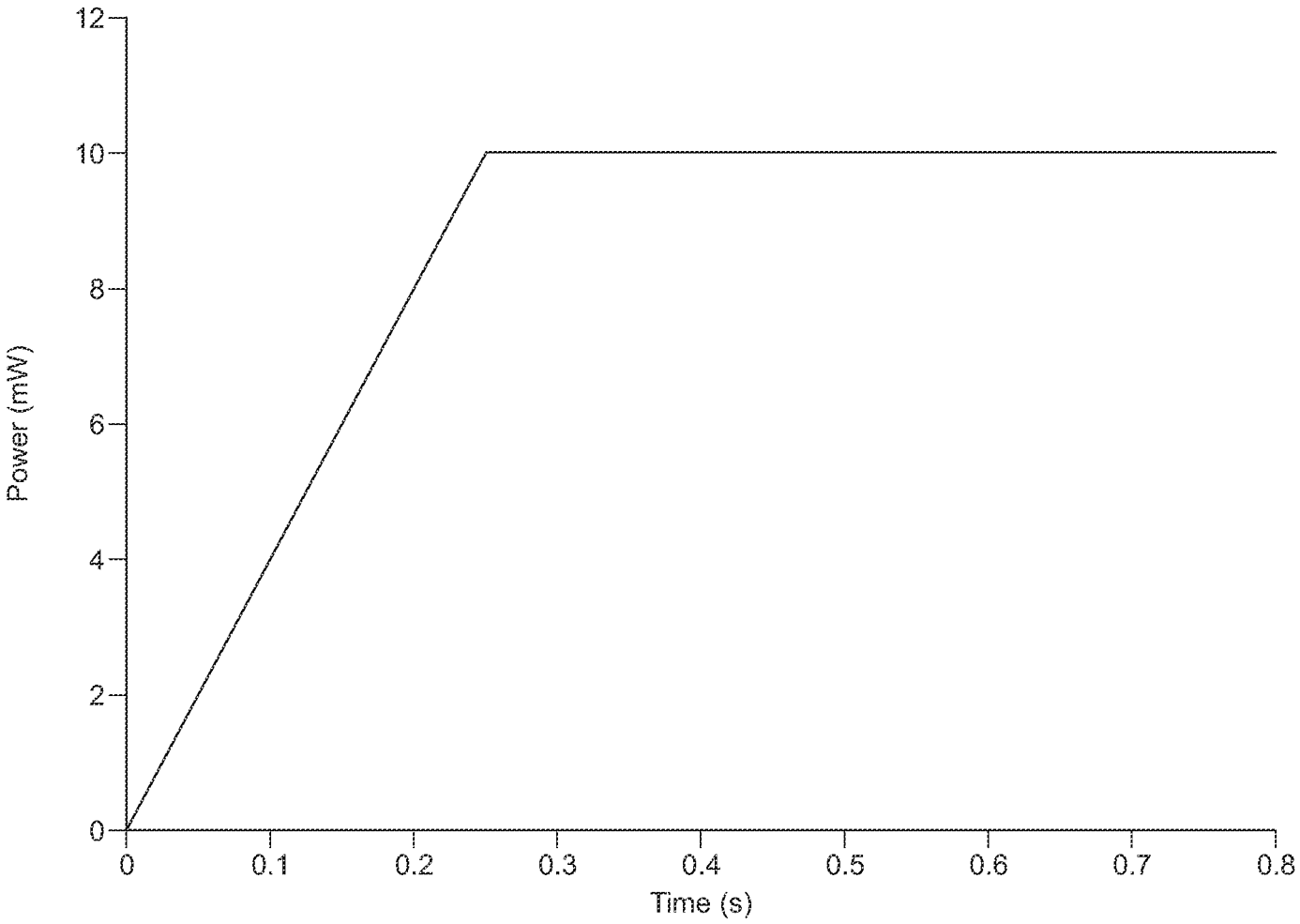

The optical system 46 is activated when the suction source 18 of the vacuum cleaner 10 is switched on by the user. The controller 58 of the vacuum cleaner 10 supplies power to the controller 56 of the cleaner head 16, which controls the supply of power to the light source 52 of the optical system so as to control the output optical power of the light source 52. Whilst the controller 56 may control the power supplied to the light source so that the output optical power is at a maximum, in this embodiment 10 mW, immediately after the suction source 18 is switched on, in this embodiment, the controller 56 controls the power supplied to the light source so that the output optical power increases gradually to the maximum over a period of time from when the suction source 18 is switched on. This can reduce power consumption at the start of a cleaning process, and reduce the risk that the user being exposed to the full output optical power of the light source 52 whilst the user may still being in the process of positioning the cleaner head 16 for the start of the cleaning process. With reference to FIG. 5, this period of time is preferably less than a few seconds, and in this embodiment is 0.25 sec.

The controller 58 is arranged to stop supplying power to the controller 56 when the suction source 18 is switched off by the user, or when the battery is exhausted, which in turn causes the light source 52 to become turned off.

The controller 56 may also vary the output optical power of the light source 52 away from the maximum during the cleaning process. As illustrated in FIG. 4, the cleaner head 16 may comprise a sensor 60 for monitoring a condition of the cleaner head 16, and for outputting a signal to the controller 56 depending on the monitored condition, in response to which the controller 56 may vary the output optical power of the light source 52. For example, the sensor 60 may be arranged to detect the pressure within the suction cavity or the neck of the cleaner head 16, and the controller 56 may be arranged to reduce, or suspend, the supply of power to the optical system 46 depending on a signal received from the sensor 60 which is indicative of the detected pressure. For example, the pressure within the cleaner head 16 can vary if the cleaner head 16 is lifted from the work surface, for example to reposition the cleaner head 16 on the work surface or during movement of the vacuum cleaner 10 to a different part of a room or other environment, and the output optical power of the light source 52 can be reduced whilst the cleaner head 16 is spaced from the work surface. When the signal received from the sensor 60 indicates that the cleaner head 16 has returned to a work surface, the controller 56 increases the power supplied to the optical system 46 so that the output optical power of the light source 52 returns to the maximum value. As another example, the sensor 60 may be arranged to detect the orientation of the cleaner head 16, which can also provide an indication that the cleaner head 16 has been lifted from the work surface.

The invention claimed is:

1. A cleaner head comprising:

an upper surface, a front edge, a rear edge, and spaced apart side walls extending between the front and rear edges;

an optical system housing abutting one of the side walls and located proximate the front edge;

a suction chamber defined by the upper surface, front edge, rear edge, optical system housing, and the side wall opposite the optical system housing, the suction chamber configured to open toward a work surface opposite the upper surface; and an optical system for illuminating debris upon a region of the work surface located in front of the front edge of the cleaner head when the cleaner head is disposed upon the work surface, the optical system comprising a light source which emits green light, wherein the optical system is housed within the optical system housing such that the optical system is located proximate the front edge and between the suction chamber and the side wall proximal to the optical system housing.

2. The cleaner head according to claim 1, wherein the cleaner head comprises an agitator, and the optical system is located to one side of the agitator.

3. The cleaner head according to claim 1, wherein the optical system is positioned so that a central axis of a light beam emitted by the optical system contacts a horizontal work surface upon which the cleaner head is located at an acute angle in the range from 0 to 10°.

4. The cleaner head according to claim 3, wherein the acute angle is in the range from 0 to 5°.

5. The cleaner head according to claim 1, wherein the optical system is positioned so that a light beam is emitted from the cleaner head at a height of less than 10 mm from a work surface upon which cleaner head is located.

6. The cleaner head according to claim 1, wherein the majority of the region of the work surface upon which debris is illuminated by the optical system is bounded by two planes each containing a respective side wall of the cleaner head.

7. The cleaner head according to claim 1, wherein the optical system comprises a beam shaping component operable to receive light emitted from the light source and direct the light towards the work surface such that, when the cleaner head is disposed upon a planar work surface, the optical system illuminates debris lying upon a region of the work surface which is in the shape of a sector.

8. The cleaner head according to claim 7, wherein the beam shaping component comprises a lens.

9. The cleaner head according to claim 7, wherein a central axis of the sector is aligned at an angle in the range from 35 to 65° to the front edge of the cleaner head.

10. A floor cleaner apparatus comprising:

the cleaner head according to claim 1; and a suction source for drawing an airflow into the vacuum cleaner through the cleaner head.

11. The floor cleaner apparatus according to claim 10, in the form of a handheld vacuum cleaner.

12. The floor cleaner apparatus according to claim 10, in the form of a battery-powered vacuum cleaner.

13. The floor cleaner apparatus according to claim 10, comprising a controller for controlling the optical system.

14. The floor cleaner apparatus according to claim 13, wherein the controller is arranged to actuate the optical system when the suction source of the vacuum cleaner is switched on.

15. A cleaner head comprising:

an upper surface, a front edge, a rear edge, and spaced apart side walls extending between the front and rear edges;

an agitator disposed between the side walls; and an optical system for illuminating debris upon a region of a work surface located in front of the front edge of the cleaner head when the cleaner head is disposed upon the work surface, the optical system comprising a light source which emits green light, wherein the optical system is located proximate the front edge and between one of the side walls and the agitator.

* * * * *